US005727807A

United States Patent [19]

Krafft et al.

[11] Patent Number: 5,727,807

[45] Date of Patent: Mar. 17, 1998

[54] SKI STRUCTURED IN ACCORDANCE WITH CURVED GLIDING ZONES AND FLAT GLIDING ZONES ALONG THE SKI

[75] Inventors: Bertrand Krafft, Aix Les Bains; Gilles Silva, Le Montcel; Jacques Le Masson, Cran Gevrier, all of France

[73] Assignee: Salomon S.A., Metz-Tessy, France

[21] Appl. No.: 348,240

[22] Filed: Nov. 28, 1994

[30] Foreign Application Priority Data

Dec. 9, 1993 [FR] France ..... 93 15020

[51] Int. Cl.[6] ..... A63C 5/04

[52] U.S. Cl. ..... 280/609; 280/608

[58] Field of Search ..... 280/604, 608, 280/609, 11.18, 28

[56] References Cited

U.S. PATENT DOCUMENTS

| | | | |
|---|---|---|---|
| 4,272,577 | 6/1981 | Lyng | 280/609 X |
| 4,406,478 | 9/1983 | Staufer | 280/609 X |
| 4,635,954 | 1/1987 | Arnsteiner | 280/604 |
| 5,328,200 | 7/1994 | Pelizzari | 280/609 |
| 5,344,177 | 9/1994 | Rouser et al. | 280/604 X |

FOREIGN PATENT DOCUMENTS

| | | | |
|---|---|---|---|
| 934319 | 5/1948 | France | 280/609 |
| 2643565 | 8/1990 | France . | |
| 2654005 | 5/1991 | France . | |
| 2683730 | 5/1993 | France . | |
| 961335 | 10/1956 | Germany . | |
| 1108599 | 6/1961 | Germany . | |
| 2623852 | 12/1976 | Germany | 280/609 |
| 2621490 | 12/1977 | Germany | 280/604 |
| 2838793 | 4/1979 | Germany | 280/609 |
| 4033235 | 5/1991 | Germany | 280/609 |
| 161592 | 7/1933 | Switzerland | 280/609 |
| 331559 | 9/1958 | Switzerland . | |
| 670571 | 6/1989 | Switzerland . | |

*Primary Examiner*—Brian L. Johnson
*Assistant Examiner*—Min Yu
*Attorney, Agent, or Firm*—Greenblum & Bernstein, P.L.C.

[57] ABSTRACT

A ski having a sole equipped with discontinuous serrations including a central flat gliding zone and on one side, at least, a lateral curved gliding zone bordering the central zone. The surface of the rear portion at least, of the central zone between the rear contact line and the center line of the boot of the ski is equipped with a pronounced structuring such that the measured values of the significant roughness parameters Rtm and Rku are greater than the values measured on the surface of the lateral curved gliding zone. The invention is more specifically related to an alpine ski whose ability to pivot and to glide are thus improved.

27 Claims, 4 Drawing Sheets

11
5
6
7
$\ell_2$
L
$\ell_1$
10

11
5
12
6
7
10

11
5
10
ΔL $l_1$
$l_2$
50

$l_1$
$l_2$
50

$l_1$
$l_2$
50a
50b

SKI STRUCTURED IN ACCORDANCE WITH CURVED GLIDING ZONES AND FLAT GLIDING ZONES ALONG THE SKI

BACKGROUND OF THE INVENTION

1. Field of the Invention

The invention is related to a snow ski, such as an alpine ski, a monoski, or a snowboard.

More specifically, it is related to a ski having a lower sole equipped with serrations whose gliding ability has been improved.

2. Discussion of Background and Material Information

Specialists in the field of skis recognize that the sole that is in contact with the snow should not remain completely smooth in order to obtain a correct gliding of the ski. Due to the effect of friction and the pressure that is exerted, grains of snow melt and get transformed into micro-droplets that have a tendency to get packed and to form a film of lubricating water. As such, it is important to obtain a structuring of the sole that enables the breakage and removal of such film so as to avoid suction phenomena that resist gliding.

This knowledge has resulted in the disclosure of a certain number of patents presenting more or less empirical solutions in response to the problems raised by such phenomena.

In Swiss Patent Publication No. 161,592 the sole is equipped in its central portion with a plurality of parallel and rectilinear grooves that extend continuously over approximately one third of the length and over the entire width of the gliding surface.

The disadvantage is that one obtains an extremely directional ski with which it becomes very difficult to take turns at high speeds. To overcome this, it was thought to shorten the length of the grooves and to regroup them into rows separated from one another as disclosed in French Patent Publication No. 2,654,005. In this solution, the surface structure reunites, on the one hand, an adequate formation and guidance effect for the water layer, and on the other hand, appropriate breakage of the water layer without providing the ski with a substantial directional effect.

Finally, in French Patent Publication No. 2,683,730, the gliding surface is equipped with discontinuous serrations oriented in the longitudinal direction, that are wavy in shape, having overall sinuous curves, so as preferably to provide the sole with a roughness coefficient Ra that is comprised within an appropriate value range.

All prior art solutions have mainly concentrated on working on the shape, length and orientation of the serrations without considering which zones ought to receive optimally such a structuring and which zones ought not to get structured, or only lightly structured.

SUMMARY OF THE INVENTION

An object of the invention is to provide a satisfactory solution to these problems.

A gliding surface has zones that are biased differently on the snow and, consequently, structuring should be done in consideration thereof.

The central sole region plays an important role in the flat gliding of the ski, and it is therefore important that it be strongly structured so as to enable a good runoff and so as to avoid the suction phenomenon.

While executing turns, the skier bends the ski along one or the other side running edges. The sole thus remains in contact with the snow along a side region having a small width and bordering on the central region. The pressure exerted by the weight of the skier over this small surface is therefore substantial and it therefore becomes important to reduce friction as much as possible by providing a smooth surface or one where the structuring is less pronounced. In fact, one must give greater importance to the support and gripping properties of the running edges, While reducing the "guiding" effects that are due to the structuring of the sole that could resist turn execution. The problem of the film of water is secondary in this configuration.

An object of the invention is therefore to provide a snow ski that includes a lower surface having variable width (L) made of a plastic material, equipped with a plurality of discontinuous serrations and two side running edges that laterally border the surface, which rests on a forward contact line and a rear contact line when the ski does not bear a load. The lower surface includes a central flat gliding zone extending between both contact lines, and at least on one side, a lateral curved gliding zone bordering the central zone between both contact lines, whose width (l1) is greater than 0.03 L; the surface of at least the rear portion of the central zone, between the rear contact line and the center line of the ski boot, being provided with a strong or heavy structuring so that the measured values of the significant roughness parameters Rtm and Rku are greater than the values measured on the surface of the lateral curved gliding zone.

Preferably, the lower surface comprises two symmetrical lateral zones with respect to the longitudinal axis of the ski, bordering the central zone on both sides.

The retained parameters Rtm and Rku are among those roughness parameters that enable a better appreciation, on a surface, of the difference between a strong or pronounced efficient structuring for the breakage or removal of the film of water as per the invention, and a finer, less pronounced structuring limiting friction with the snow while executing turns.

The Rtm parameter designates the average of the maximum roughnesses that measure the vertical distance between the uppermost and the lowermost points of the roughness section over the total evaluation length, as per standard DIN 4762/1E or ISO 4287/1.

The Rku parameter (Kurtosis Roughness) designates the flattening parameter of the density of height distribution. The flatter the density curve, the greater the Rku; on the other hand, if the curve is pointed and its peak is well centered, the Rku is less (ISO standard 4287/1).

In particular, the Rtm value is less than or equal to 15 μm and the Rku value is less than or equal to 3 in the surface of the lateral zone(s), whereas Rtm>15 μm and Rku>3 in the rear portion, at least, of the central zone as has been defined previously.

According to another characteristic, width (l1) of the lateral zone(s) is comprised between 0.03 L and 0.3 L, it being understood that width (l2) of the central zone for flat gliding should remain greater than or equal to 0.45 L.

Advantageously, the width (l1) of the lateral zone(s) increases from the vicinity of the minimum lower surface width line (L min) in the direction of the contact lines. Indeed, it is advantageous to reserve a larger non-serrated or lightly serrated surface at the level of the ends so as to improve the pivoting ability of the ski. Thus, it is preferable that width (l1) be greater than or equal to 2 mm in the vicinity of the lower surface width line (L min) and greater than or equal to 10 mm in the vicinity of the contact lines of the ski.

According to a characteristic related to the previous one, width (l2) of the central zone is strongly or heavily serrated and constant. Such a structuring can be easily obtained by a repetitive and reproducible technique by passing a hot tool over the sole, in a single pass.

In accordance with a complementary characteristic, the structuring of the central zone is obtained by the heat passage, under pressure, of a tool on the sole, the tool having the shape of a roller comprising a raised design having a constant edge width (l) on the surface from which is formed a plurality of discontinuous ribs.

According to an alternative characteristic, the width (l1) of the lateral zone(s) is constant and the width (l2) of the central flat gliding zone increases progressively from the vicinity of the minimum width (L min) in the direction of the contact lines.

In this case, it is preferable that the width (l1) of the lateral zones(s) be greater than or equal to 6 mm.

According to another more general characteristic, the heavily structured central zone comprises a plurality of short serrations, that are rectilinear and discontinuous, and arranged in separate or meshed rows.

According to a complementary characteristic, at least a majority of the serrations are oriented along the longitudinal axis of the ski. Some, however, can be inclined at a certain angle with respect to the longitudinal axis, so as to mainly avoid too much of a "rail" effect or also to improve the disengagement of the film of water under certain snow conditions or for certain types of skis.

It can also be provided that the structuring has such a roughness gradient that the measured parameters Rtm and Rku increase progressively from the running edge towards the longitudinal axis over a significant portion, at least, of the lower surface width, it being understood that the roughness (Rtm and Rku) can remain substantially constant over small width portions. This can be the case, for example, by providing a progressive increase in the density of the serrations, and an increase in certain serration parameters (depth, width, length, shape, etc.).

Similarly, it may be preferable to envision that the structuring along the longitudinal axis has such a roughness gradient that the measured Rtm and Rku parameters vary progressively, from the rear contact line in the direction of the forward contact line, over a substantial portion at least of the length of the ski, it being understood that the roughness can remain substantially constant over certain length portions.

BRIEF DESCRIPTION OF THE DRAWINGS

Many other characteristics of the invention will become apparent from the description that follows as per the non-limiting embodiments of a ski as per the invention, with reference to the annexed schematic drawings wherein.

DETAILED DESCRIPTION OF THE PREFERRED EMBODIMENTS

Figure 1:
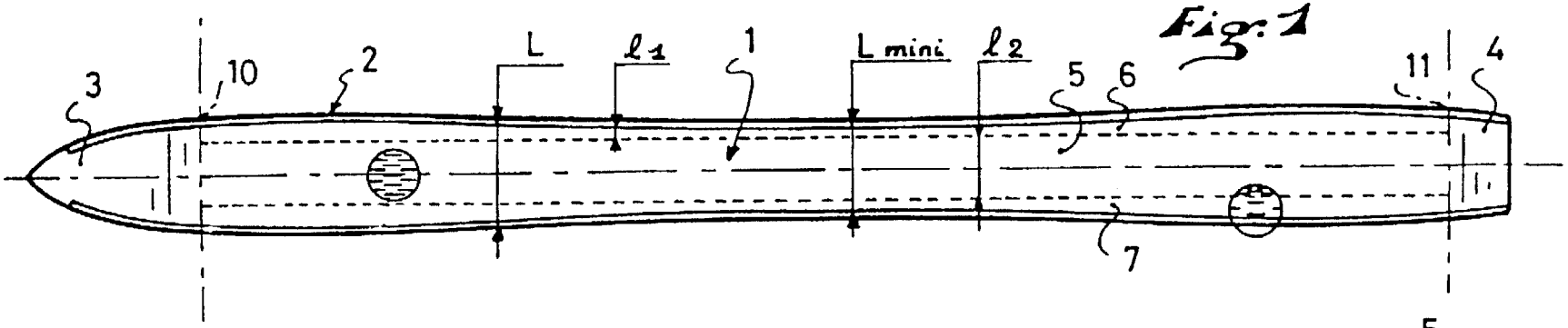
FIG. 1 represents a first embodiment of the gliding surface in a top view of the ski as per the invention.
Figure 1B:
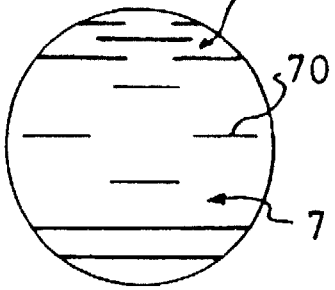
FIGS. 1*a* and 1*b* are enlarged, detailed views of FIG. 1.

The example of FIG. 1 represents an alpine ski in a bottom view, where one can distinguish the lower surface or gliding sole 1 made of polyethylene, the side running edges 2, the shovel 3 and tail 4.

The sole is cambered and rests on a front contact line 10 and a rear contact line 11 when the ski does not bear a load. The surface comprised between these two contact lines 10, 11 meets the snow due to the weight of the skier and becomes the so-called "bearing" surface of the ski.

Figure 1A:
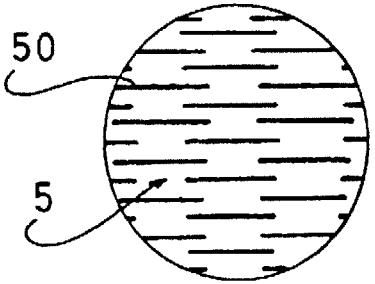

The bearing surface comprises a central zone 5 called the "flat gliding" zone, having a width l2 in which substantial structuring is obtained. FIG. 1*a* shows, in an enlarged view, an example of substantial structuring as per the invention. This could be a plurality of short, rectilinear and discontinuous serrations 50, arranged in rows that are meshed into one another.

On either side of central zone 5, the bearing zone comprises two lateral zones 6, 7 for curved gliding, having a width l1. These zones (FIG. 16) have a less pronounced structuring in which the serrations 70 are more spaced, shorter, less deep and less wide, for example, than the serrations in the central zone (FIG. 1*a*). The structuring can also be quasi non-existent and the surface can be as smooth as possible.

Figure 2:
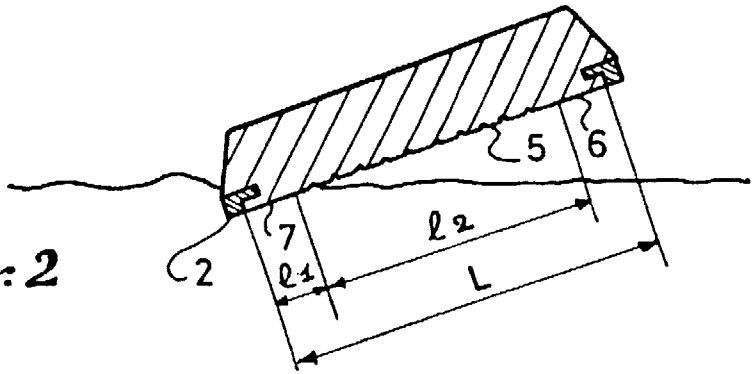
FIG. 2 illustrates a sectional view of the ski of FIG. 1 while executing a turn.

FIG. 2 shows the ski when a turn is taken and its inclination with respect to the terrain surface. A portion of the sole penetrates more or less deeply into the snow or ice, according to the prevailing conditions, by virtue of the cut exerted by the running edge 2. One can understand the usefulness of reserving a zone 7 of width l1 of the bearing surface that has minimum friction with the snow, central zone 5 of width l2 being almost never in contact with the snow during the turn.

In the example illustrated, as in all the embodiments of the invention, width L of the sole varies to follow the side cut of the ski. Width l1 is always greater than 0.03 L, at all points of width L of the sole, measured between contact lines 10, 11. Preferably, l1 is comprised between 0.03 L and 0.3 L, it being understood that l2 must remain greater than or equal to 0.45 L. As an example, in a traditional alpine ski, l1 can be comprised between 3 mm and 25 mm approximately, and l2 is greater than 27 mm.

In the example illustrated, l2 is constant between contact lines 10, 11 and thus, l1 varies progressively. In particular, width l1 of each lateral zone 6, 7 increases progressively in the direction of contact lines 10, 11 from the smallest L min width L, located in the vicinity of the center of the bearing surface.

In snow trials, the following surface characteristics of central zone 5 are consistent with the aforementioned objects of the invention:

serration depth: comprised between 0.02 mm and 0.08 mm;

serration length: comprised between 10 mm and 60 mm;

serration width: comprised between 0.1 mm and 0.3 mm;

design: meshed rows;

Rtm coefficient: comprised between 20 μm and 80 μm;

Rku coefficient: comprised between 5 and 35.

The measurement of the roughness parameters is undertaken perpendicularly with respect to the longitudinal axis of the ski, as are the width measurements L, l1, l2.

Figure 3:
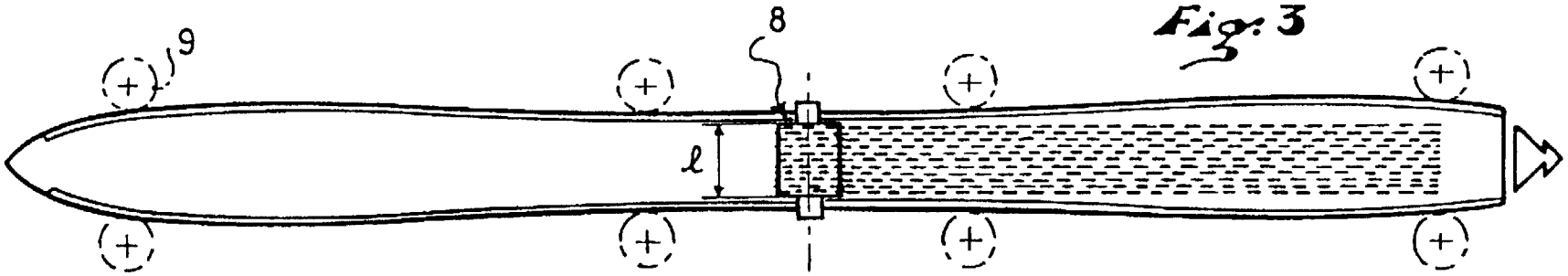
FIGS. 3 and 4 show an embodiment of the structuring of the sole of a ski of FIG. 1.
Figure 4:
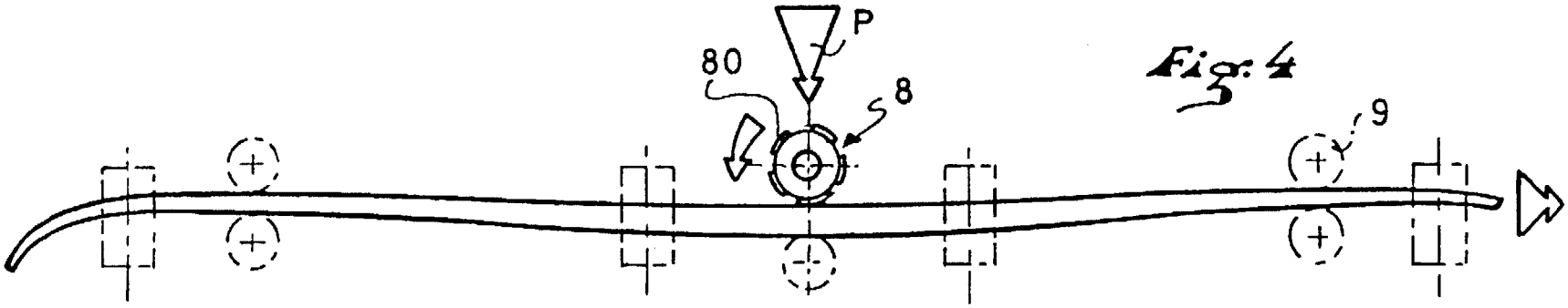

FIGS. 3 and 4 illustrate an advantageous example enabling a structuring of the sole of a ski as per the invention to be obtained, and more particularly in the case where one wants to obtain a constant width l2 for central zone 5 of the lower surface conferring a variable width l1 for the lateral zones 6, 7.

For this, a device comprising a heated tool 8 is used, the tool having the shape of a roller that has a raised design on its surface of a constant edge width L, comprising a plurality of discontinuous ribs 80. The surface of the roller is applied, under pressure, against the surface of sole 1 of the ski to be prepared, by undertaking a longitudinal run of the ski between several guide plates 9. It can also be provided that the ski remains immobile and the tool moves with respect to the ski, as an entirely equivalent means. According to the nature of the material constituting the sole and the dimensions of the serrations to be obtained, the pressure and temperature conditions can be adapted without any special difficulties, so as to obtain satisfactory and reproducible results.

As a non-limiting example, for a sole of the high density polyethylene type and in case the serrations are obtained as per the aforementioned characteristics provided as examples, it is preferable to work at a temperature comprised between 80° and 120° C., and to exert pressure on the surface of the sole by the revolving tool 8.

In such a method, it is not necessary to undertake several passes of the tool over the surface. On the other hand, however, it is not forbidden to rework the surface by a finishing process enabling micro-structuring over the entire sole, for example, by using techniques that are well known to a person skilled in the art, as for example, by stone polishing, for example.

Figure 5:
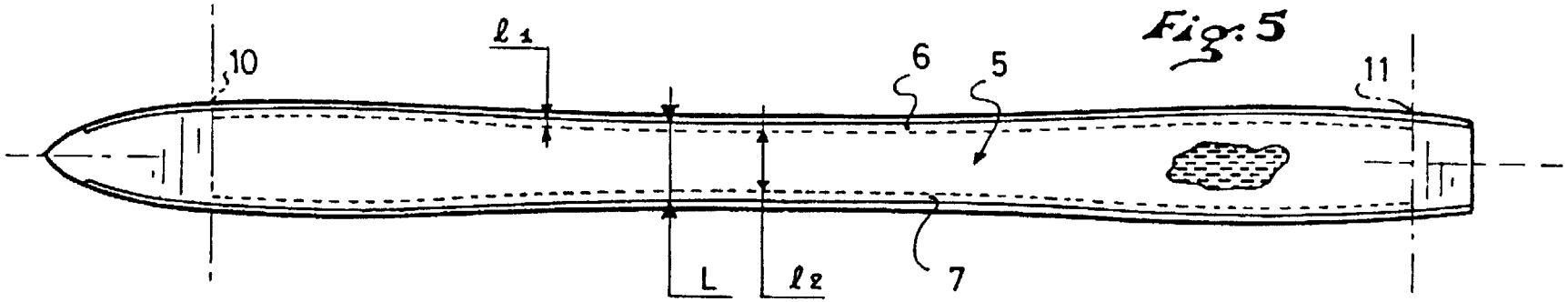
FIG. 5 is a second embodiment of the gliding surface as per the invention in a top view, similar to the view of FIG. 1.

FIG. 5 shows a variation of the invention wherein width l1 of the lateral curved gliding zones is constant along the ski. Due to the side cut of the ski, therefore, that confers a variable width L in the shape of a "wasp waist" to the lower surface, width l2 of the central flat gliding zone is also variable along the ski and increases from the vicinity of the width line L min in the direction of the contact lines 10, 11 of the ski.

Figure 6:
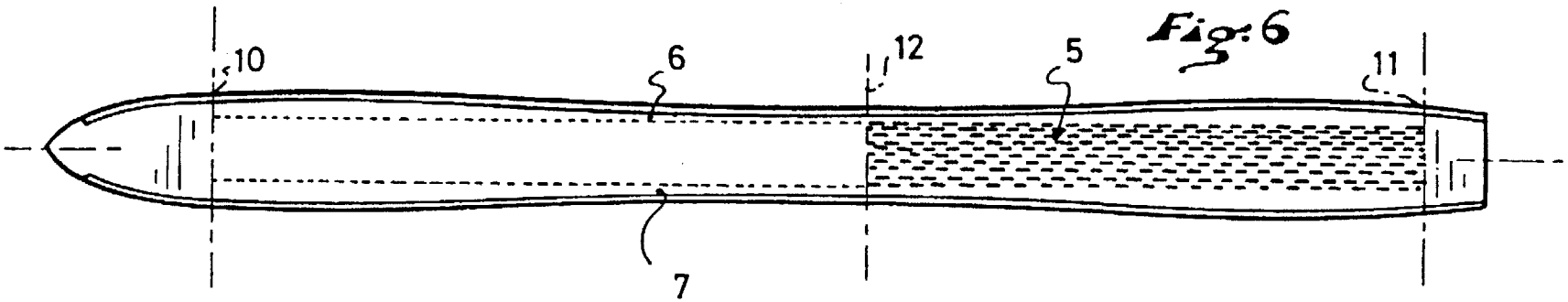
FIG. 6 illustrates another embodiment as per a variation of FIG. 5.

In FIG. 6, only the rear portion of central zone 5 comprised between the rear contact line 11 and the boot center line 12 is embellished with serrations. Boot center line 12 is a line provided by each manufacturer and its position with respect to the center of the ski can vary from one type of ski to another.

The front portion comprised between forward contact line 10 and the boot center line 12 is lightly or non-serrated such that the roughness parameters Rtm and Rku defined in the front portion are close to or equal to the respective values of the lateral curved gliding zones 6, 7. Tests undertaken by the Applicants have demonstrated that such a configuration can perform better in certain snow conditions.

Figures 7, 8, 9, 10:
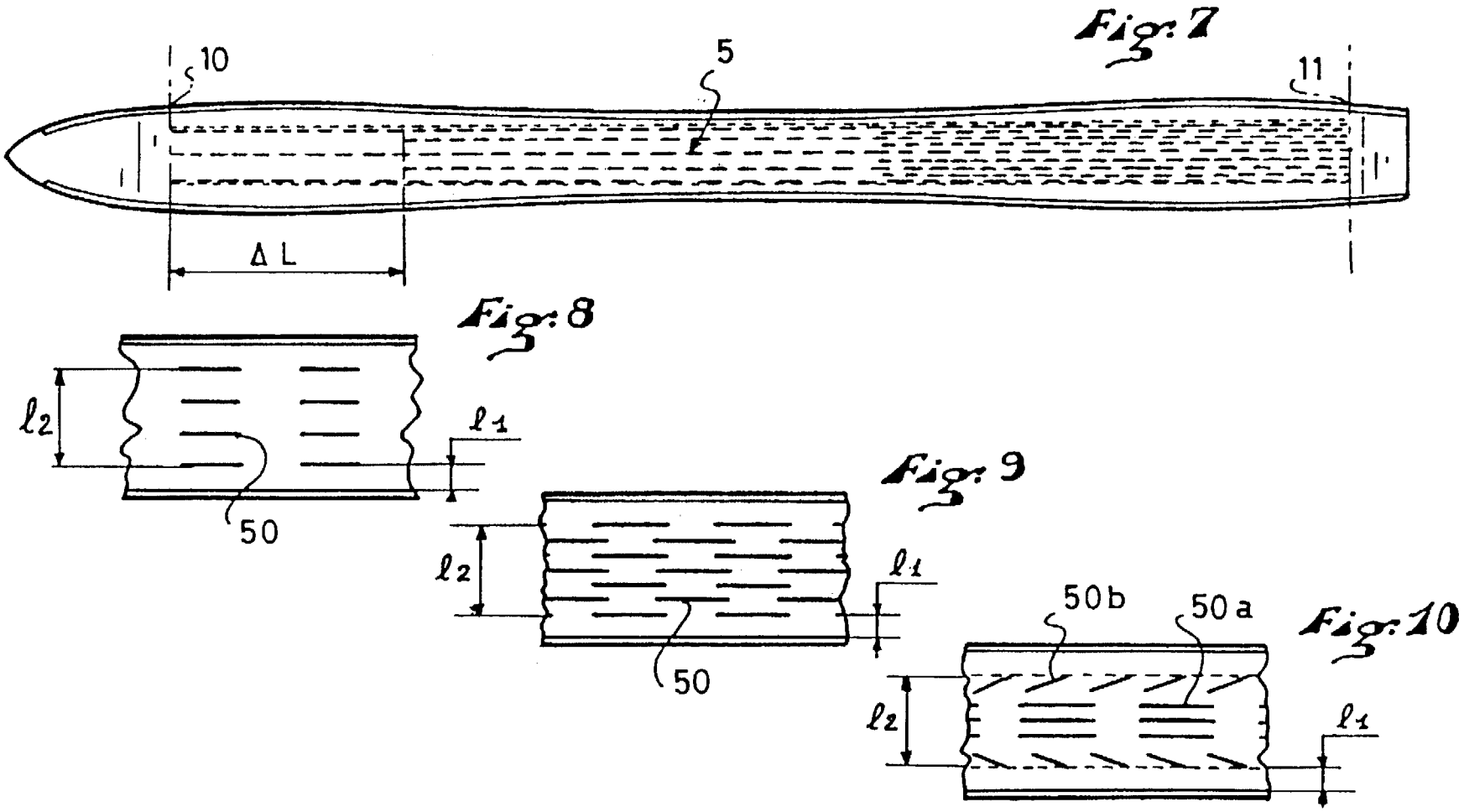
FIG. 7 is another embodiment as per another variation.
FIGS. 8, 9, and 10 are detailed views of various examples of the structuring as per the invention.

In the case of FIG. 7, the structuring of central zone 5 has such a roughness gradient that the measured parameters Rtm and Rku decrease progressively, from the rear contact line 11 towards the forward contact line 10. This gradient can be obtained, for example, by progressively reducing the number of serrations and their dimensions (length, width and depth), from rear line 11 towards forward line 10.

It can be provided that on certain short width portions ΔL of the lower surface, values Rtm and Rku can remain substantially constant in central zone 5. Thus, it can advantageously be provided that the decreasing progression of values Rtm and Rku be done by stages, i.e., by a succession of short, adjacent portions in which values Rtm and Rku are substantially constant, but vary from one adjacent portion to the other.

FIGS. 8 through 10 represent non-limiting examples of the positioning of the serrations on the gliding surface as per the invention. Among the serrations equipping the surface, one can have:

serrations 50 that are parallel and arranged in separate rows, oriented longitudinally (FIG. 8);

parallel serrations, in meshed rows, oriented longitudinally (FIG. 9);

parallel serrations oriented longitudinally **50*a* and others that are inclined 50*b* (FIG. 10**).

The length of the serrations can vary, generally between 4 mm and 50 mm, according to the type of snow and type of ski used.

Naturally, the invention is not limited to the embodiments described and represented hereinabove, but can also comprise all technical equivalents thereof as well as their combinations that can be included within the scope of the following claims.

What is claimed is:

1. A ski comprising:

a lower surface having a variable width, said lower surface comprising a plastic material, said lower surface further having a front contact line, a rear contact line, and a boot center line, the ski being supported at said front contact line and said rear contact line when the ski is not loaded, said lower surface further comprising a central gliding zone between said front contact line and said rear contact line, said lower surface further comprising a laterally curved gliding zone bordering said central gliding zone on at least one lateral side of said central gliding zone, said laterally curved gliding zone having a width, between said front contact line and said rear contact line, greater than 0.03 of said width of said lower surface, said lower surface having a plurality of discontinuous serrations defined by roughness parameters Rtm and Rku, said roughness parameters Rtm and Rku measured at said central gliding zone, at least between said rear contact line and said boot center line, having values greater than said roughness parameters Rtm and Rku measured at said at least one laterally curved gliding zone;

said central gliding zone of said lower surface, between said serrations, being substantially flat; and a pair of side running edges laterally bordering said lower surface.

2. A ski according to claim 1, wherein:

said serrations have a depth of between 0.02 mm and 0.08 mm.

3. A ski according to claim 1, wherein:

said laterally curved gliding zone bordering said central gliding zone on at least one lateral side of the ski comprises a pair of laterally curved gliding zones laterally bordering said central gliding zone.

4. A ski according to claim 3, wherein:

said pair of laterally curved gliding zones are symmetrical with respect to a longitudinal axis of the ski.

5. A ski according to claim 4, wherein:

measured at each of said laterally curved gliding zones, said roughness parameter Rtm is less than or equal to 15 μm and said roughness parameter Rku is less than or equal to 3; and measured at said central gliding zone, at least between said rear contact line and said boot center line, said roughness parameter Rtm is greater than 15 μm and said roughness parameter Rku is greater than 3.

6. A ski according to claim 4, wherein:

each of said laterally curved gliding zones has a width between 0.03 and 0.3 of said width of said lower surface of the ski; and said central gliding zone has a width greater than or equal to 0.45 of said width of said lower surface of the ski.

7. A ski according to claim 4, wherein:

at a predetermined position along a length of the ski, said lower surface has a minimum width; and said width of each of said laterally curved gliding zones increases from a vicinity of said predetermined position toward said front contact line and from the vicinity of said predetermined position toward said rear contact line.

8. A ski according to claim 7 wherein:

said central gliding zone, at least between said rear contact line and said boot center line, comprises a heavily serrated zone, said serrated zone having a constant width.

9. A ski according to claim 4, wherein:

at a predetermined position along a length of the ski, said lower surface has a minimum width; and said width of each of said laterally curved gliding zones is greater than or equal to 2 mm in a vicinity of said predetermined position; and said width of each of said laterally curved gliding zones is greater than or equal to 10 mm in a vicinity of each of said front contact line and said rear contact line.

10. A ski according to claim 4, wherein:

at a predetermined position along a length of the ski, said lower surface has a minimum width;

said width of each of said laterally curved gliding zones is constant; and said width of said central gliding zone increases progressively from a vicinity of said predetermined position toward said front contact line and from the vicinity of said predetermined position toward said rear contact line.

11. A ski according to claim 10, wherein:

said width of each of said laterally curved gliding zones is greater than or equal to 6 mm.

12. A ski according to claim 1, wherein:

measured at said laterally curved gliding zone, said roughness parameter Rtm is less than or equal to 15 μm and said roughness parameter Rku is less than or equal to 3; and measured at said central gliding zone, at least between said rear contact line and said boot center line, said roughness parameter Rtm is greater than 15 μm and said roughness parameter Rku is greater than 3.

13. A ski according to claim 1, wherein:

said width of said laterally curved gliding zone is between 0.03 and 0.3 of said width of said lower surface of the ski; and said central gliding zone has a width greater than or equal to 0.45 of said width of said lower surface of the ski.

14. A ski according to claim 1, wherein:

at a predetermined position along a length of the ski, said lower surface has a minimum width; and said width of said laterally curved gliding zone increases from a vicinity of said predetermined position toward said front contact line and from the vicinity of said predetermined position toward said rear contact line.

15. A ski according to claim 14, wherein:

said central gliding zone, at least between said rear contact line and said boot center line, comprises a heavily serrated zone, said serrated zone having a constant width.

16. A ski according to claim 1, wherein:

at a predetermined position along a length of the ski, said lower surface has a minimum width;

said width of said laterally curved gliding zone is greater than or equal to 2 mm in a vicinity of said predetermined position; and said width of said laterally curved gliding zone is greater than or equal to 10 mm in a vicinity of each of said front contact line and said rear contact line.

17. A ski according to claim 1, wherein:

at a predetermined position along a length of the ski, said lower surface has a minimum width;

said width of said laterally curved gliding zone is constant; and said width of said central guiding zone increases progressively from a vicinity of said predetermined position toward said front contact line and from the vicinity of said predetermined position toward said rear contact line.

18. A ski according to claim 17, wherein:

said width of said laterally curved gliding zone is greater than or equal to 6 mm.

19. A ski according to claim 1, wherein:

said central gliding zone, at least between said rear contact line and said boot center line, comprises a heavily serrated zone; and said serrations in said heavily serrated zone comprise a plurality of short, rectilinear and discontinuous serrations, arranged in separate or meshed rows.

20. A ski according to claim 19, wherein most of said serrations in said heavily serrated zone are oriented along a longitudinal axis of the ski.

21. A ski according to claim 1, wherein:

said serrations define a roughness gradient of said lower surface whereby said roughness parameters Rtm and Rku have values that increase progressively from each of said running edges toward a longitudinal central axis of the ski over a significant portion of said width of said lower surface of the ski.

22. A ski according to claim 1, wherein:

said serrations define a roughness gradient of said lower surface whereby said roughness parameters Rtm and Rku have values that increase progressively from each of said running edges toward a longitudinal central axis of the ski over a significant portion of said width of said lower surface of the ski, said roughness parameters Rtm and Rku remaining substantially constant over predetermined small width portions.

23. A ski according to claim 1, wherein:

said serrations define a roughness gradient of said lower surface whereby said roughness parameters Rtm and Rku have values that vary progressively from said rear contact line toward said front contact line over a significant portion of a length of said lower surface of the ski.

24. A ski according to claim 1, wherein:

said serrations define a roughness gradient of said lower surface whereby said roughness parameters Rtm and Rku have values that vary progressively from said rear contact line toward said front contact line over a significant portion of a length of said lower surface of the ski, said roughness parameters Rtm and Rku remaining substantially constant over predetermined small length portions.

25. A ski according to claim 1, wherein:

said serrations have a length of between 10 mm and 60 mm.

26. A ski according to claim 1, wherein:

said serrations have a width of between 0.1 mm and 0.3 mm.

27. A ski according to claim 1, wherein:

said serrations are discrete and spaced apart.

* * * * *